US005690520A

United States Patent [19]

Rheault

[11] Patent Number: 5,690,520

[45] Date of Patent: Nov. 25, 1997

[54] WEED REMOVAL APPARATUS FOR A JET PUMP PROPELLED WATERCRAFT

[75] Inventor: Alain Rheault, St-Nicolas, Canada

[73] Assignee: Bombardier Inc., Montreal, Canada

[21] Appl. No.: 545,550

[22] Filed: Oct. 19, 1995

[51] Int. Cl.[6] ..... B63H 11/01

[52] U.S. Cl. ..... 440/46

[58] Field of Search ..... 440/38, 40, 41, 440/42, 43, 46, 47, 83; 60/221, 222

[56] References Cited

U.S. PATENT DOCUMENTS

| | | | |
|---|---|---|---|
| 3,147,733 | 9/1964 | Engel . | |
| 3,306,046 | 2/1967 | Trapp | 440/46 |
| 3,343,368 | 9/1967 | Castoldi . | |
| 3,347,203 | 10/1967 | Starry . | |
| 3,446,177 | 5/1969 | Thornburg et al. . | |
| 3,580,210 | 5/1971 | Svensen . | |
| 3,677,215 | 7/1972 | Moss | 440/43 |
| 3,809,492 | 5/1974 | Takaeda et al. | 440/46 |
| 3,854,437 | 12/1974 | Stansbury | 440/43 |
| 3,943,876 | 3/1976 | Kiekhaefer | 440/43 |

*Primary Examiner*—Stephen Avila

*Attorney, Agent, or Firm*—Morgan & Finnegan, L.L.P.

[57] ABSTRACT

A weedless system has been developed for personal watercraft which obtain their power by using jet propelled water pumps. The unique weedless system has a number of elements which help to reduce weed congestion in the jet pump. Firstly, a plurality of downwardly directed grates, which terminate at the head of the ride shoe, are used such that weeds striking such grates will tend to slide off the grates rather than become embroiled around them. In addition, between the venturi and the steering nozzle there is located a butterfly valve which can be manually closed or opened by the operator. Closure of the butterfly valve creates a rotating movement of the water within the jet pump to provoke shaking, cutting and dislodging of weeds that go through the great barrier. The weeds then pass out through the water inlet back through a weed outlet passage or become pulverized such that they will pass safely past the jet pump when the valve is reopened and the boat regains normal efficiency.

5 Claims, 7 Drawing Sheets

WEED REMOVAL APPARATUS FOR A JET PUMP PROPELLED WATERCRAFT

DISCLOSURE

This invention relates to personal watercraft, and more particularly, to a weed removal system for watercraft propelled by jet pumps.

BACKGROUND

As personal watercraft become more popular and are used on many lakes and inland waterways, problems of debris and weeds entering the jet pump through the water intake opening, have increased. It has been found that in some weed infested waters that the jet pump can become completely clogged, and it is almost impossible for the operator to dislodge the weeds without removing the craft from the water and removing the inlet grate. Clearly this is a very time consuming and sometimes hazardous operation.

In the prior art watercraft, weeds can become stuck to the grate, the nose of the ride shoe, the impeller stator and the drive shaft. This buildup of weeds provokes cavitation and a great loss of performance of the jet pump to a point where propulsion by the pump is insufficient to give the thrust required to push the watercraft or permit it to plane.

It is an object of the present invention to provide a reactive apparatus to clean the jet pump of weeds which have succeeded going through the grate, to the shaft and impeller system.

It is a further object of the present invention to avoid any safety hazard due to manual cleaning operation of the shaft, impeller or stator vein from the inside or outside of the watercraft when weeds or other typical debris have reached those elements.

It is also an object of the present invention to permit the operation of a watercraft powered by a jet pump in a hazardous weed environment, and to easily and quickly, without damage to the pump system, clean out weeds to recover pump system performance.

The system uses three components. A grate is normally used to prevent debris from entering the water intake. In the present invention, the individual grate arms or elongate members terminate prior to the commencement of the ride plate. This will permit both weed passage and backflow while the cleaning process is in process.

A shaft cover is installed over the drive shaft. This avoids weeds from gripping the shaft as the shaft rotates, thereby reducing cavitation.

Finally, a butterfly valve is used to close the pump outlet which causes a backflow of water and weeds thereby dislodging most of the weeds from the interior of the pump area so that the weeds can depart the water inlet through the weed exit passage.

Closing the butterfly valve stops the water flow through the jet pump because once the rearward flow stops, weeds are not pulled against the edges or other portions of the mechanism. Water tends to spin with great turbulence, shaking all the weeds to permit dislodgement from edges of the machinery. The impeller, while still turning, cuts weeds dislodged. The butterfly valve can be opened to permit evacuation of this mixture that is cut and dislodged. If cavitation still occurs, the process is repeated until there is a complete recovery of the thrust. The open rear portion of the grate also helps to evacuate some of the mixture thereby accelerating the cleaning process.

The butterfly valve of the present invention is located at the Junction of the venturi and the steering nozzle. The steering nozzle, which contains a vertically oriented rudder therein, is attached to the venturi of the pump by means of a vertically oriented shaft. By moving the steering nozzle directional arm, the boat can be steered to the right or to the left. Also located on the same shaft is a vertically oriented butterfly valve which will substantially stop any water outflow through the nozzle. The butterfly valve has a control lever which, when activated, will move the valve 90 degrees from a closed position where its planar surface is perpendicular to the direction of travel, to an open position where the plane is parallel to the direction of travel.

Therefore this invention seeks to provide a blocking means for removing weeds and debris from an impeller in a jet pump propelled watercraft; said blocking means being mounted downstream from said impeller; said blocking means being moveable from an open position to a closed position; wherein, in operation, when said blocking means is in said open position, propelled water passes freely from an intake opening through said impeller through a venturi, and exits at the rear of said watercraft, and when said blocking means is in said closed position water is prevented from exiting at the rear of said watercraft, thereby producing back pressure and turbulence which dislodges weeds and debris from said impeller.

DETAILED DESCRIPTION OF THE INVENTION

Figure 1:
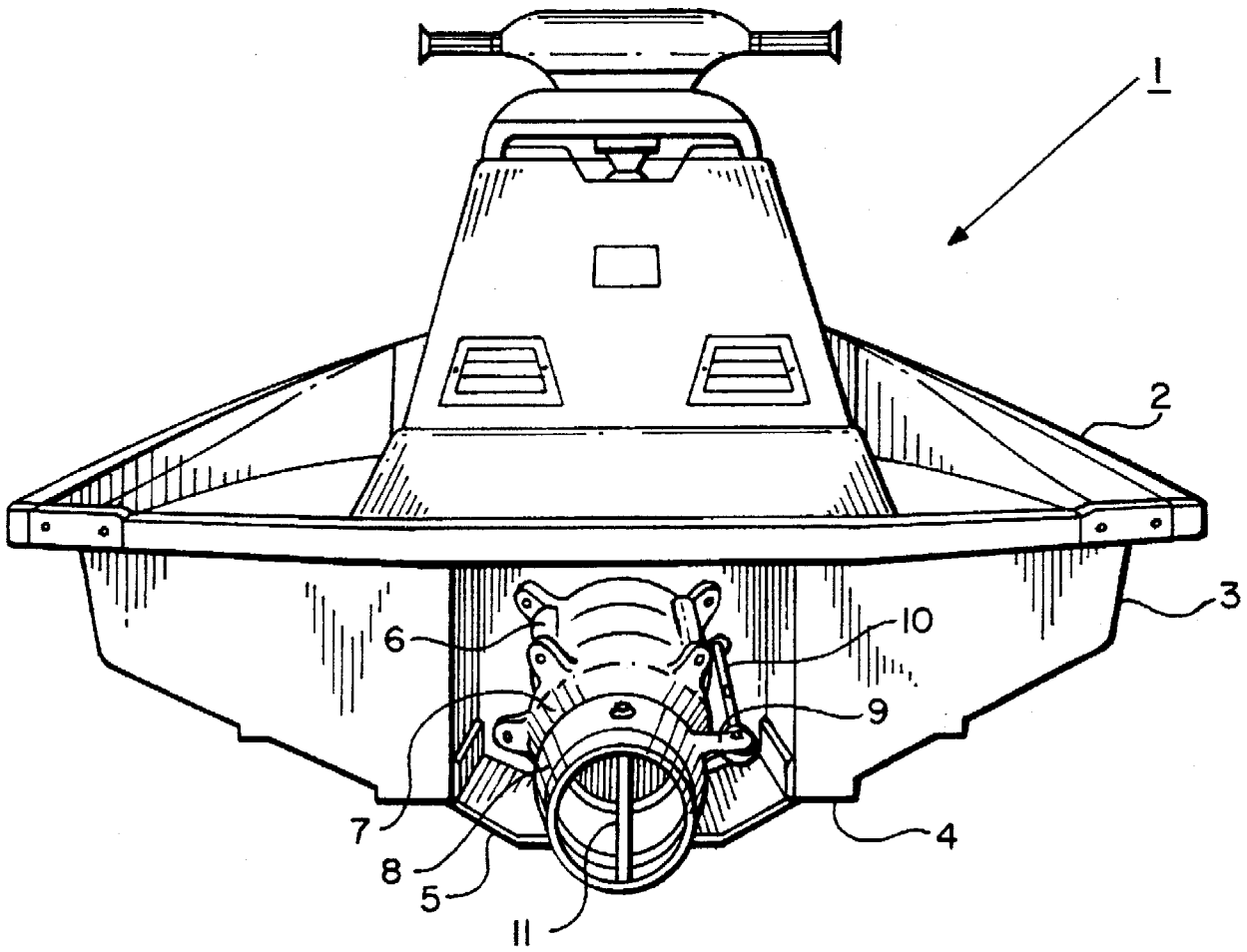
FIG. 1 is a rear view of a prior art personal watercraft.

In FIG. 1, a personal watercraft is shown generally as 1 being comprised principally of deck 2 and a hull 3. The bottom of the hull is marked as 4. There is a jet pump within a jet pump housing 6, a venturi section 7, and a pivotal steering nozzle 8. Steering nozzle 8 is moved by way of steering nozzle directional arm 9, coupled to linkage 10. Steering nozzle 8 has a vertically oriented rudder 11, permanently affixed within steering nozzle 8.

One notes that the pump, venturi, and steering nozzle assembly is set within the hull, and is protected by a ride plate 5 which is configured to the bottom 4 of the hull 3.

Figure 2:
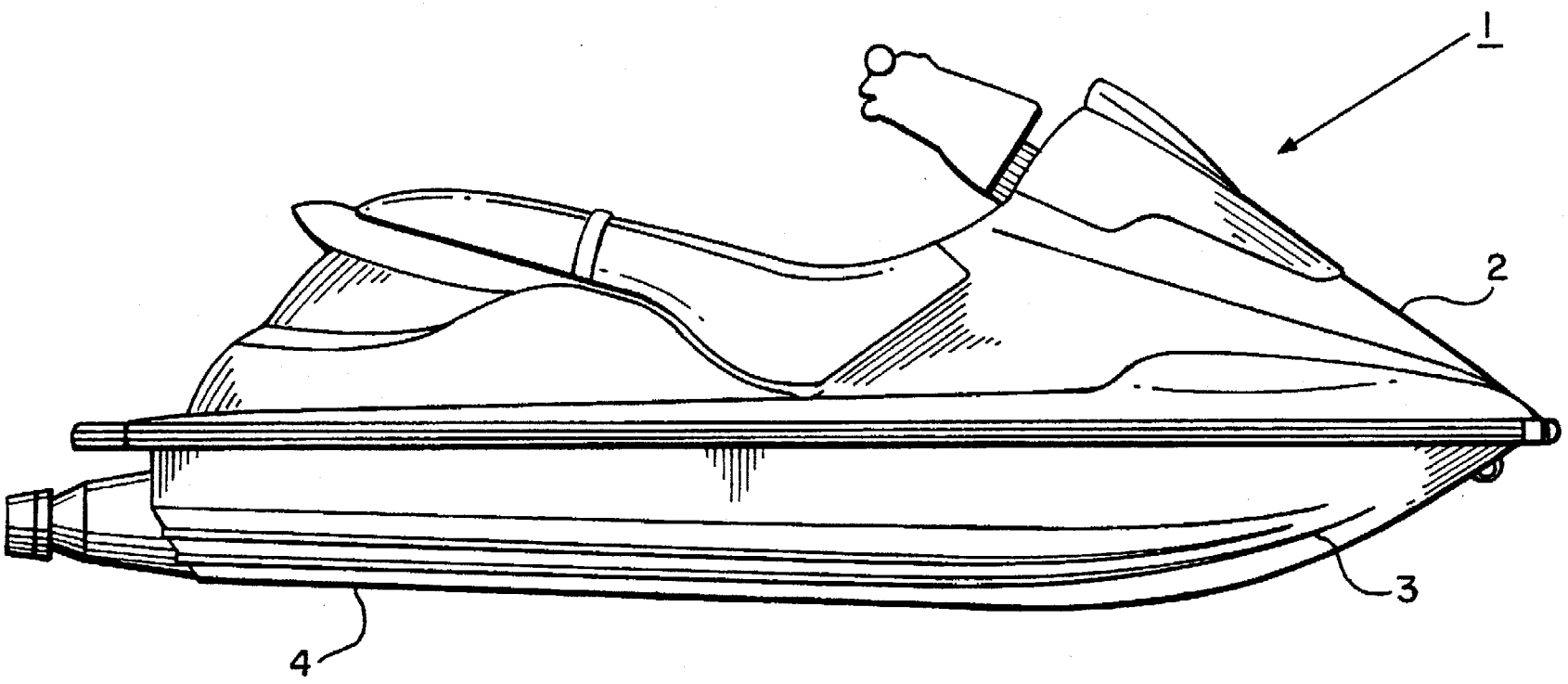
FIG. 2 is a underside view of a personal watercraft of the present invention.

FIG. 2 is a side view of a watercraft of the present invention.

Figure 3:
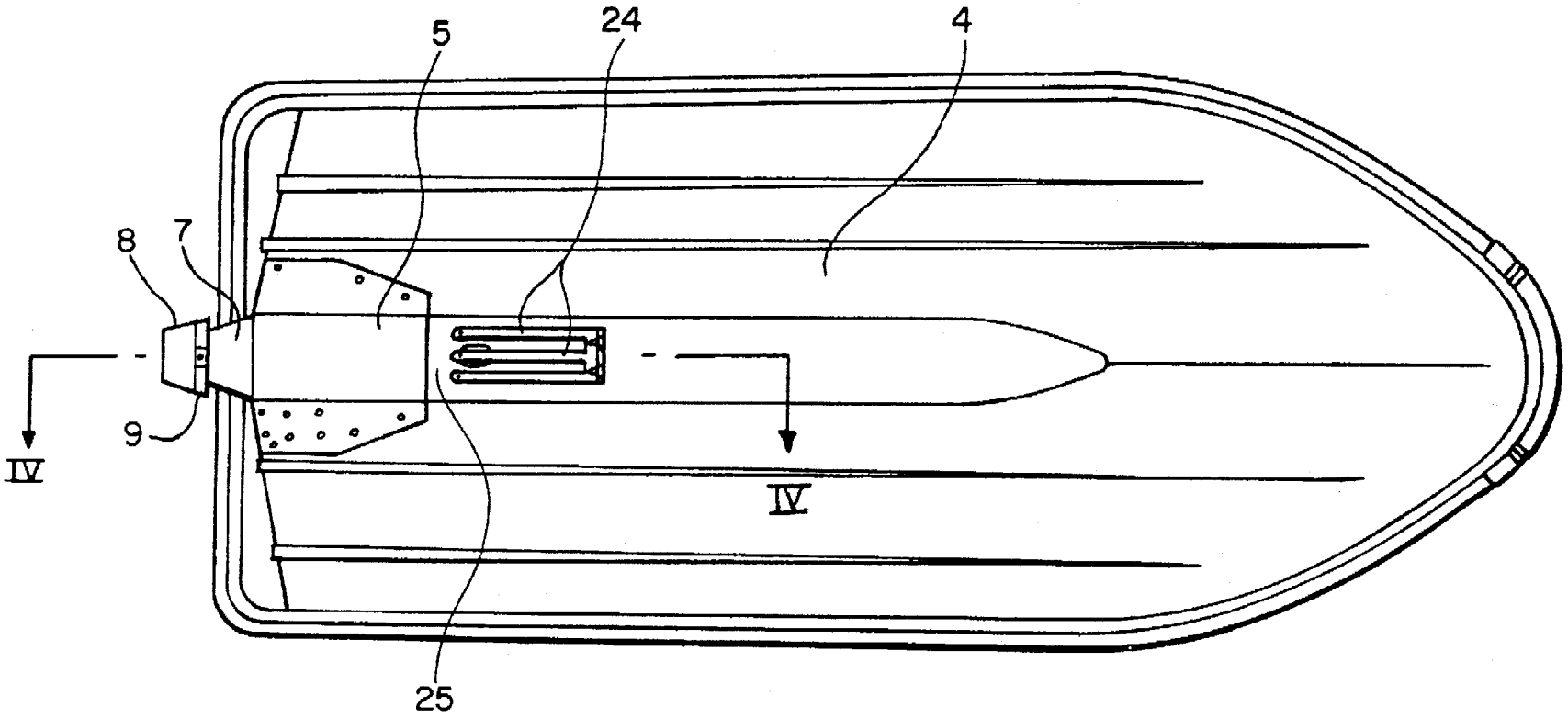
FIG. 3 is a side view of a personal watercraft of the present invention.

In FIG. 3, one views the present invention from the underside. Similar numerals are employed for similar parts as that of FIG. 1. Water enters a pump propulsion chamber through grate 24. One notes that the individual grates which make up grate 24 terminate prior to the front portion of the ride plate 5, leaving a gap 25, which will be discussed later.

Figure 4:
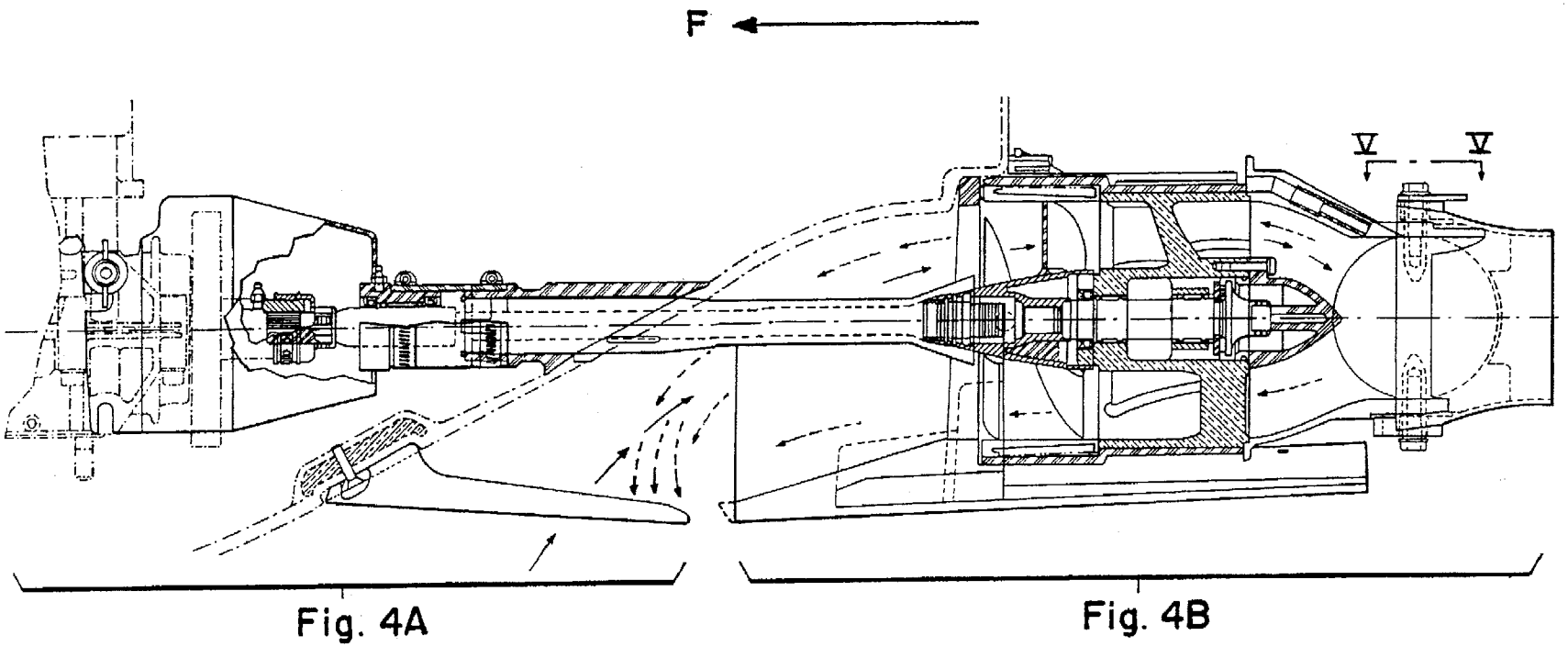
FIG. 4 is a longitudinal cross-section taken along the mid point IV.IV of FIG. 3.
Figure 4A:
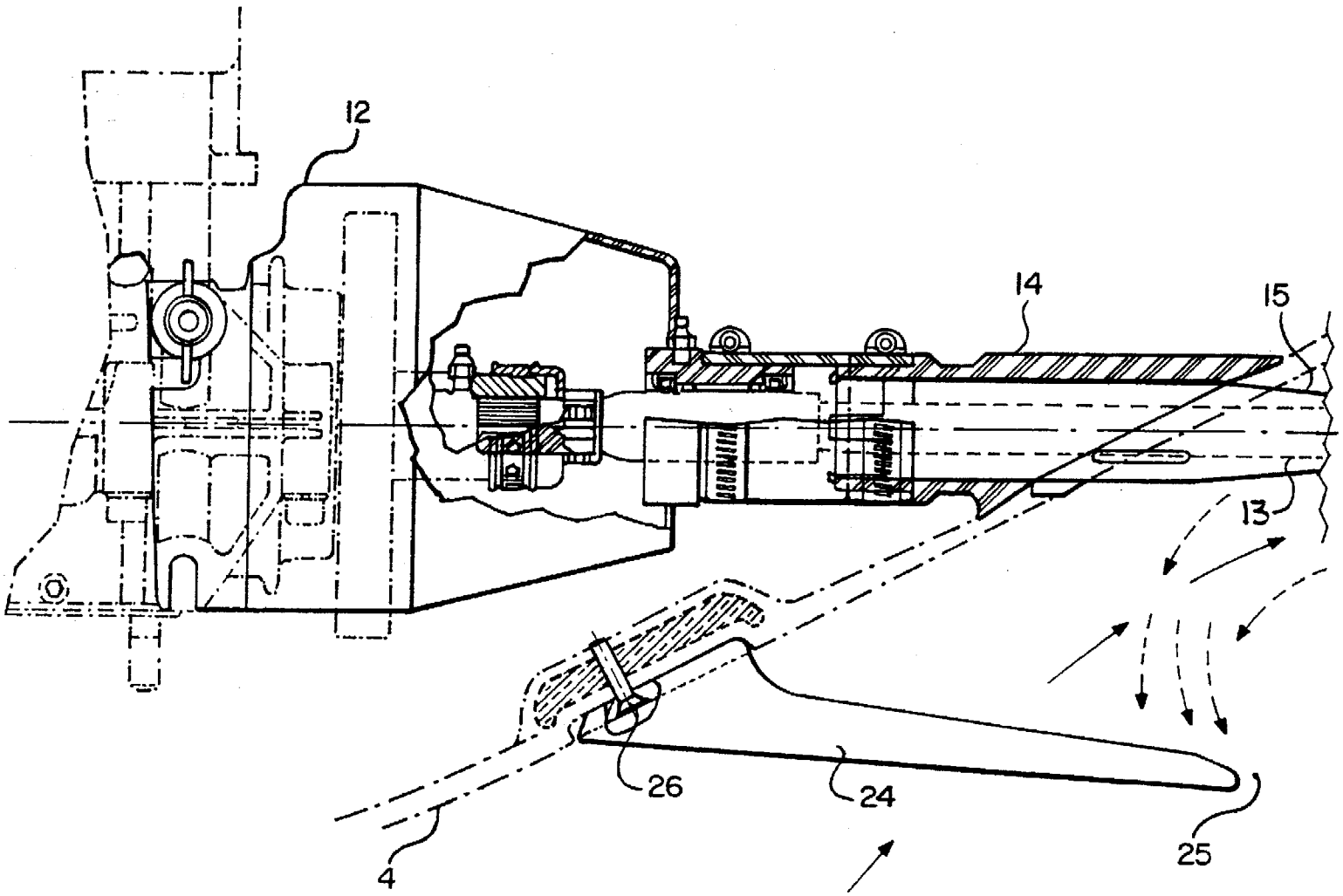
FIG. 4A is an expanded view of the left portion of FIG. 4.
Figure 4B:
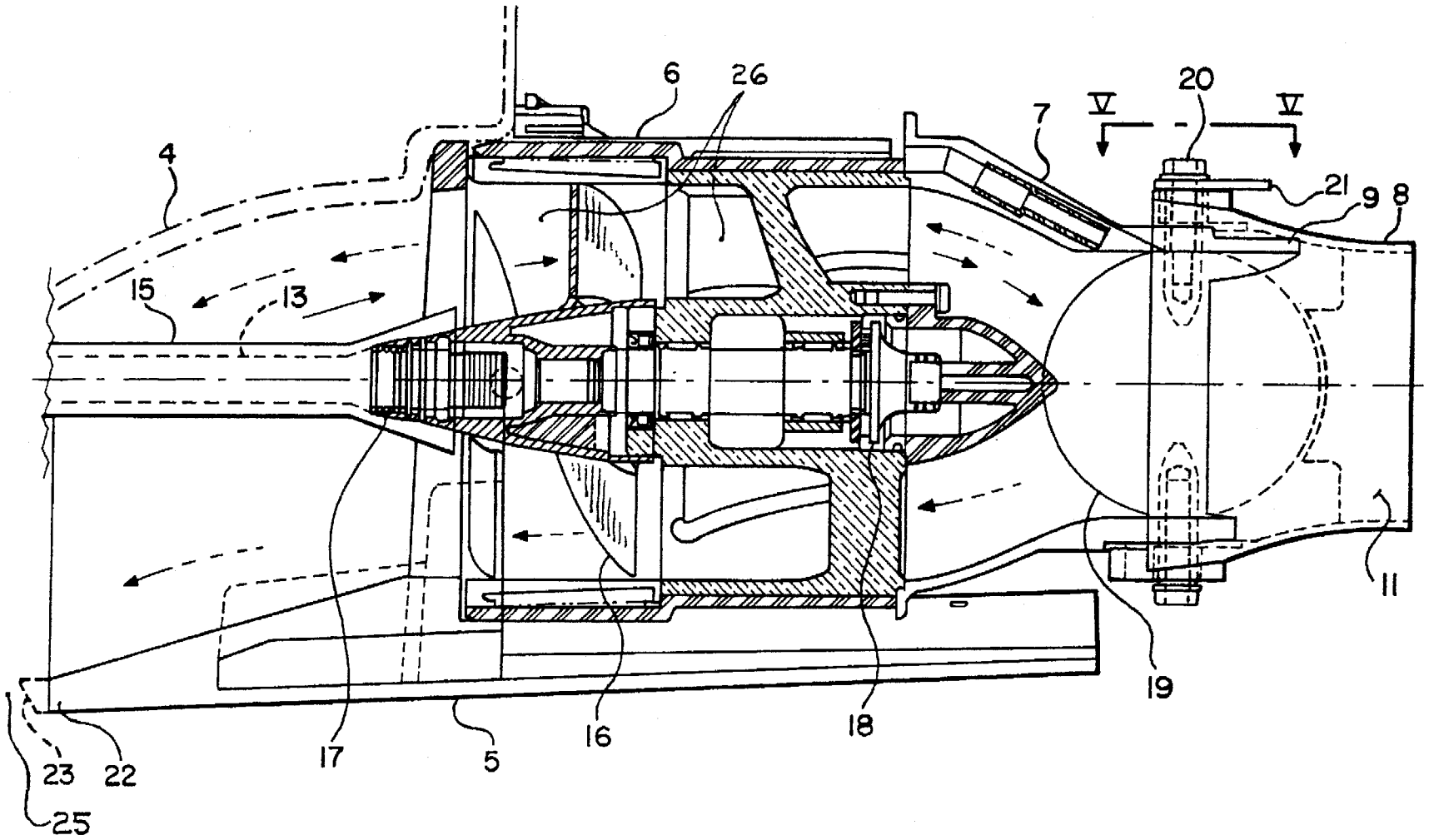
FIG. 4B is an expanded view of the right side of FIG. 4.

FIG. 4 is a longitudinal cross section through the rear portion of the hull 3, taken along line IV.IV of FIG. 3. FIG. 4, for the sake of clarity, has been divided into FIGS. 4A and 4B. In FIG. 4B water jet pump housing 6 is housed in a recess under and within the hull bottom 4. As shown in FIG. 4A, a two-cycle engine 12 provides the power for the watercraft. It connects to a drive shaft 13 which passes through the hull bottom 4, slightly ahead of the engine. A drive shaft seal 14 surrounds the drive shaft and prevents water from entering the hull.

As shown in FIG. 4B, drive shaft 13, which is rotating when the boat is in operation, is protected by a non-rotating drive shaft cover 15. Drive shaft 13 is fixedly attached to an impeller 16 which, upon rotation, provides the water power, which is forced through water jet pump housing 6, and out through venturi 7, which converges rearwardly, promoting a faster flow of water. Impeller 16 is protected by impeller casing 17. To the rear of the impeller 16 is the stator vane 18. Nozzle 8 is pivotally attached to venturi 7 by means of vertically oriented shaft 20. Also pivotally attached to shaft 20 is a butterfly valve 19, which is the subject matter of the present invention. Butterfly valve 19 is moved by control lever 21 which is connected to a suitable linkage (not shown).

Butterfly valve 19 can be closed or opened, which when in the open position permits the propelled water to be quickly moved out of the nozzle 8. When butterfly valve 19 is closed, the boat can have no forward movement as the water is trapped within the pump housing and venturi.

As can be seen by a series of solid arrows in FIGS. 4A and 4B, water to supply the impeller enters through the bottom of the boat between the hull bottom 4 and the ride shoe 5. As seen in FIG. 4A, a series of downwardly directed water intake grates 24 are used in order to deflect debris and other foreign bodies which could harm the impeller 16. Water intake grates 24 are mounted to the bottom of the hull 4 by means of screws 26 or other acceptable fasteners.

Between the nose 22 of the ride shoe 5 and the rearmost portion of water intake grates 24, is a small passage which, for the purpose of this invention, will be called a weed outlet passage marked as 25. In FIG. 4B, there is an alternative ride shoe nose configuration 23, shown in dotted lines. This alternative configuration of ride shoe nose 23 is adapted to move any weeds, which catch on ride shoe nose 23, downwardly, as the nose is rearwardly and downwardly slanted.

Figure 5:
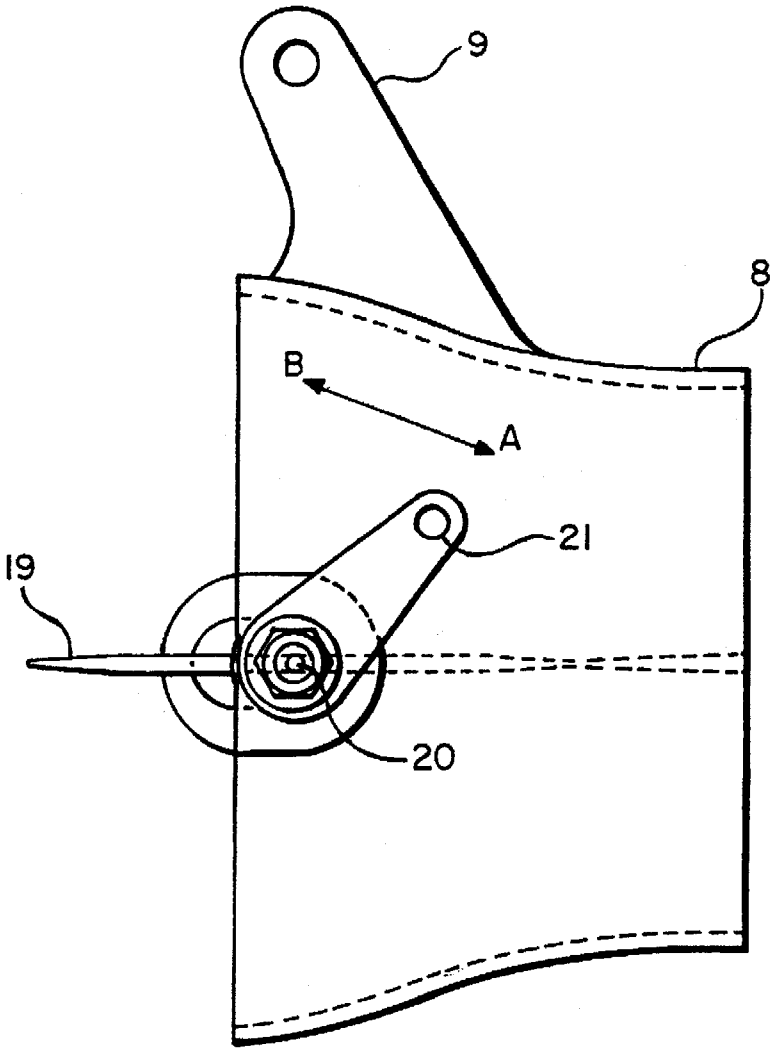
FIG. 5 is a transverse section taken along lines V.V of FIG. 4.

In FIG. 5, which is a transverse section taken along lines V.V of FIG. 4, one notes steering nozzle shaft 20, butterfly valve 19, and butterfly valve control lever 21, which is adapted to move from the open position A to the closed position B by way of known linkages (not shown).

In operation, (as the boat moves in a forward direction as shown by arrow F in FIG. 4), water will enter through the bottom of the boat through water intake grates 24 and weed outlet passage 25, in the direction of the solid arrows. Water moves past the impeller and stator and out through the venturi 7, to steering nozzle 8.

For normal operation, butterfly valve 19 is kept wide open, i.e. the plane of the butterfly valve is in the forward rearward direction, as shown in FIG. 4B.

Water intake grates 24 stop short of ride shoe nose 22 and are slightly downwardly directed. When weeds or other debris strike the water intake grates 24, they tend to be deflected and slide off the end below the ride shoe and behind the boat. With the alternate ride shoe nose configuration 23, even those weeds which strike the ride shoe nose 23, may be deflected downwardly. Nevertheless, in heavily weed infested waters, some weeds will pass into the area of the impeller 16 and drive shaft 13, and decrease the efficiency of the impeller.

In prior art watercraft, the drive shaft 13 is continually rotating and weeds tend to wind around the drive shaft, and become caught. Stationary drive shaft cover 15 of the present invention alleviates this problem considerably.

In operation, if the operator of the boat senses that the efficiency has been decreased due to weed intake in the pump area, he simply pulls on a suitable manual linkage connected to control lever 21, moving it from position A to position B. This completely blocks the output of water from the jet pump even though the jet pump impeller 16 continues to revolve.

In position B the butterfly valve 19 is in the closed position such that the plane of the butterfly valve is perpendicular to the direction of travel. This will cause turbulence and backflow within the pump propulsion chamber 26 near the impeller 16. Some water will move forwardly in the direction of the dashed arrows. At the same time the impeller will cut the weeds which are moving in an opposite direction, and force the debris out through weed outlet passage 25.

The process can be repeated several times for heavily congested weeds. The result is much the same as an outboard motor which can be cleared by forward and reverse movements, although in the case of the present invention, the impeller always moves in the same direction.

Once the pump propulsion area 26 and impeller 16 are free of weeds, the butterfly valve 19 is opened completely and the watercraft moves at its regular speed and efficiency.

Although a particular embodiment of the invention has been described, it is to be understood that any means for blocking the outflow of water from a jet pump propelled watercraft on a temporary basis is encompassed by the present invention.

What I claim as my invention is:

1. A blocking means for removing weeds and debris from an impeller in a jet pump propelled watercraft;

said blocking means being mounted downstream said impeller;

said blocking means comprising a butterfly valve;

said butterfly valve being mounted on a shaft for pivotal movement between an open position and a closed position, said butterfly valve being mounted on said shaft in common with a steering nozzle;

said steering nozzle being pivotally mounted on said shaft at a rear end of a venturi;

said steering nozzle being activated, at said operating position, by an independent linkage, wherein, in operation, when said blocking means is in said open position, propelled water passes freely from an intake opening through said impeller through said venturi, and exits at the rear of said watercraft, and when said blocking means is in said closed position water is prevented from exiting at the rear of said watercraft, thereby producing back pressure and turbulence which dislodges weeds and debris from said impeller.

2. A blocking means as claimed in claim 1 wherein said intake opening is located in a recess at the bottom of said hull;

said intake opening being partially covered by a plurality of parallel elongate members;

said members forming a grate;

said members extending downwardly and rearwardly, and terminating a short distance from a front of a ride shoe, thereby creating an ungrated portion of said intake opening;

wherein, in operation, when said blocking means is in said closed position, dislodged debris and weeds may exit through said ungrated portion of said intake opening.

3. A blocking means for removing weeds and debris from an impeller in a jet pump propelled watercraft;

said impeller being fixedly connected to a revolving drive shaft;

said drive shaft including a non-revolving drive shaft protective cover;

said blocking means being mounted downstream from said impeller;

said blocking means comprising a butterfly valve, said butterfly valve being mounted on a shaft for pivotal movement between an open position and a closed position;

said butterfly valve being mounted on said shaft in common with a steering nozzle;

said steering nozzle being pivotally mounted on said shaft at a rear end of a venturi;

said steering nozzle being activated, at said operating position, by an independent linkage;

wherein, in operation, when said impeller and said drive shaft are rotating, weeds and other debris are prevented from winding about said shaft when said blocking means is in said open position, propelled water passes freely from an intake opening through said impeller through said venturi, and exits at the rear of said watercraft, and when said blocking means is in said closed position water is prevented from exiting at the rear of said watercraft, thereby producing back pressure and turbulence which dislodged weeds and debris from said impeller.

4. A method of removing weeds and debris from an impeller of a jet pump propelled watercraft;

said watercraft including a partially ungrated water inlet and a rear water outlet, comprising the steps of:

(a) activating said jet pump;

(b) closing a butterfly valve mounted on an axis downstream of said jet pump thereby preventing propelled water from exiting from the rear of said watercraft thus creating turbulence around said impeller and forcing a portion of said weeds and said debris from said impeller to exit through said partially ungrated water inlet;

(c) opening said butterfly valve to permit water and a portion of said weeds and debris from said impeller to exit through said rear water outlet of said watercraft;

(d) repeating steps (b) and (c) until said water propulsion chamber is free of entangled weeds and debris.

5. A blocking means for removing weeds and debris from an impeller in a jet pump propelled watercraft;

said blocking means being mounted downstream from said impeller;

said blocking means comprising a butterfly valve;

said butterfly valve being mounted on a shaft for pivotal movement between an open position and a closed position;

said shaft being vertically oriented and said butterfly valve being connected to a first linkage activated from an operating position;

said butterfly valve being mounted on said shaft in common with a steering nozzle;

said steering nozzle being pivotally mounted on said shaft at a rear end of venturi;

said steering nozzle being activated, at said operating position, by a second linkage;

wherein, in operation, when said blocking means is in said open position, propelled water passes freely from an intake opening through said impeller through a venturi, and exits at the rear of said watercraft, when said blocking means is in said closed position water is prevented from exiting at the rear of said watercraft, thereby producing back pressure and turbulence which dislodges weeds and debris from said impeller.

* * * * *